United States Patent [19]

Coates et al.

[11] Patent Number: 4,798,424

[45] Date of Patent: Jan. 17, 1989

[54] REVERSIBLE CONTROL CONSOLE

[75] Inventors: Donald A. Coates, Green Lake; Philip J. Manthei; Max D. Allen, both of Ripon, all of Wis.

[73] Assignee: Speed Queen Company, Ripon, Wis.

[21] Appl. No.: 101,475

[22] Filed: Sep. 28, 1987

[51] Int. Cl.[4] ..... D06F 1/02

[52] U.S. Cl. ..... 312/257 R; 248/558; 312/228; 312/279

[58] Field of Search ..... 312/257 R, 257 SM, 257 A, 312/257 SK, 263, 279, 228; 248/558, 915; 400/473, 474, 472, 228

[56] References Cited

U.S. PATENT DOCUMENTS

| | | | |
|---|---|---|---|
| 3,253,874 | 5/1966 | Czech | 108/33 X |
| 3,347,609 | 10/1967 | Mann | 312/257 R X |
| 3,763,400 | 10/1973 | Layton et al. | 312/108 X |
| 3,936,107 | 2/1976 | Gourdeau et al. | 312/204 X |
| 3,954,244 | 5/1976 | Gopstein | 248/1 C |
| 4,003,613 | 1/1977 | Oakley | 312/257 A X |
| 4,113,331 | 9/1978 | Derdzinski et al. | 312/257 SM X |
| 4,288,133 | 9/1981 | Deatherage | 312/257 A X |
| 4,736,924 | 4/1988 | Bednar | 248/558 |

FOREIGN PATENT DOCUMENTS

| | | | |
|---|---|---|---|
| 2744923 | 4/1979 | Fed. Rep. of Germany | 312/208 |

OTHER PUBLICATIONS

Bondour et al., IBM Technical Disclosure Bulletin, Interchangable Keyboard Character Indicator, vol. 14 No. 7, 12/1971.

*Primary Examiner*—Peter A. Aschenbrenner
*Assistant Examiner*—Thomas A. Rendos
*Attorney, Agent, or Firm*—William R. Clark; Richard M. Sharkansky

[57] ABSTRACT

A reversible control console that can be mounted in alternate orientations that are substantially inverted from each other so as to provide product differentiation using universal parts. An integrally molded plastic hood has a control mounting panel and ends that have first and second alternate support edges. When the hood is mounted on the respective first edges, the mounting panel has a particular orientation and slope with respect to the top of the appliance. When the hood is mounted in the alternate position on the respective second edges, the mounting panel has a different orientation and slope with respect to the top panel. The respective orientations of the control mounting panel are inverted or substantially inverted from each other. In both mounting orientations, screw holes on the hood align with respective screw holes on the appliance top panel and the console rear panel. The hood also has ribs with projections that interlock with the rear panel.

10 Claims, 6 Drawing Sheets

REVERSIBLE CONTROL CONSOLE

BACKGROUND OF THE INVENTION

The field of the invention generally relates to appliances, and in particular to control consoles for use with such appliances.

In addition to making a variety of different models for sale under their own brand names, some appliance manufacturers also make appliances for other companies that sell them under different brand names. In many such instances, it is very important that the appliances with different brand names have market differentiation, even though they are mechanically the same or very similar. That is, for a number of reasons, it may be very important that the brands or models have substantially different appearances so that the consumers will not readily know that the different brands come from the same source or origin.

Appliances such as clothes washers, dryers, and ranges generally have substantially rectangular cabinets with laterally elongated top enclosures or control consoles that house the operator actuable controls. Typically, the rectangular cabinets appear very much the same, so it is common to attempt to obtain market differentiation by changing the appearance of the control consoles. Normally, a control console has either a separate or integral graphics panel, and it is a relatively easy matter to use a different graphics panel to provide some market differentiation. However, if the shapes of the consoles of the different brands are identical, they may still appear very similar if they are sitting next to each other on the showroom floor. Accordingly, some multibrand manufacturers have used completely different design shapes or geometries for the consoles of different brands. This, however, increases the inventory parts lists and the associated costs of fabricating different parts.

SUMMARY OF THE INVENTION

It is an object of the invention to provide product differentiation for appliances using universal parts.

It is also an object to provide a control hood mountable in a plurality of orientations to provide product differentiation.

It is a further object to provide a control hood that can be substantially inverted and mounted on the top panel of an appliance in an alternate orientation that has a substantially different visual appearance and therefore provides product differentiation. Also, it is an object that the control mounting panel of the hood have a different slope in the alternate mounting orientations.

These and other objects are provided by the invention which defines a control console for an appliance comprising a control mounting panel and means for mounting said panel in alternate first and second positions substantially inverted from each other. It may be preferable that the control mounting panel have a different slope in the first and second mounting positions. Also, it may be preferable that the console further comprises respectively alternate first and second graphics panels for positioning in front of the control mounting panel in the respective first and second mounting positions. Herein, the word "inverted" generally means that the top of the control mounting panel in the first position becomes the bottom of the control mounting panel in the second position, and vice versa. Inverted does not mean perfect inversion such that the control mounting panel would have the same slope; in fact, it is preferable that the control mounting panel have a different slope in the alternate mounting positions so as to provide product differentiation.

The invention further defines a control housing adapted for mounting on an appliance top in first and second alternate orientations, comprising a control mounting panel, a pair of end panels connected to the ends of said control mounting panel, each of the end panels having a first edge for seating on the appliance top panel in the first mounting orientation and a second edge for seating on the appliance top panel in the second mounting orientation, and means for securing the housing to the appliance top panel in both the first and second mounting orientations. It is preferable that the control mounting panel in the second orientation be substantially inverted from that of the first orientation. Also, it is preferable that the angle between the first edge and the control mounting panel be different than the angle between the second edge and the control mounting panel whereby the control mounting panel has a different slope with respect to the appliance top in the first and second orientations. Further, it is preferable that the first and second edges be at right angles to each other. Also, it is preferable that the en panels further comprise a third edge for spacing the bottom of the control mounting panel further from the appliance top in the second orientation than in the first orientation. Preferably, the housing is an integral plastic molded part.

The invention may also be practiced by a control console hood for mounting on an appliance top in alternate first and second mounting orientations substantially inverted from each other, comprising a laterally elongated face plate having at least one aperture for mounting controls, end caps mounted to the ends of the face plate, each of the end caps having first, second and third edges, the first edge supporting the housing in the first mounting orientation, the second edge supporting the housing in the alternate second mounting orientation, the third edge being between the second edge and the face plate for elevating the bottom of the face plate from the appliance in the second orientation, the first and second edges being at right angles to each other and having different angles of intersection with the plane of the face plate, and means for connecting the console hood to the appliance top panel in both the first and second alternate mounting orientations.

The invention further defines an appliance comprising an appliance cabinet having a top panel with a laterally running ridge, a console back panel connected to the top panel at the rear thereof, a control console hood having a control mounting panel and a pair of end caps each having a first edge for seating on the top panel in a first mounting orientation and a second edge perpendicular to the first edge for seating on the top panel in an alternate second mounting orientation substantially inverted from the first orientation, the control mounting panel having a different slope with respect to the top panel in the first and second orientations, and the hood further comprising means for mounting to the ridge and the console back panel in both the first and second orientations, respectively. It is preferable that the ridge and back panel each have a plurality of screw holes, and the mounting means of the hood comprise a plurality of screw holes which respectively align with the ridge and back panel screw holes in both the first and second mounting orientations of the hood. It is also preferable that the back panel have forward extending lips and that the screw holes of the back panel be located in the lip. Further, it is preferable that the hood have ribs engaging the lips of the back panel in the first and second alternate orientations. Also, it is preferable that the control mounting panel have a plurality of bosses extending inwardly and being adapted to align with a mounting bracket in both the first and second alternate orientations.

BRIEF DESCRIPTION OF THE DRAWINGS

The foregoing objects and advantages will be more fully understood by reading a description of the preferred embodiment with reference to the drawings wherein.

FIGS. *7a–c* show sequential steps in changing the orientation of the hood from the orientation of FIG. 1 to the orientation of FIG. 2.

DESCRIPTION OF THE PREFERRED EMBODIMENT

Figure 1:
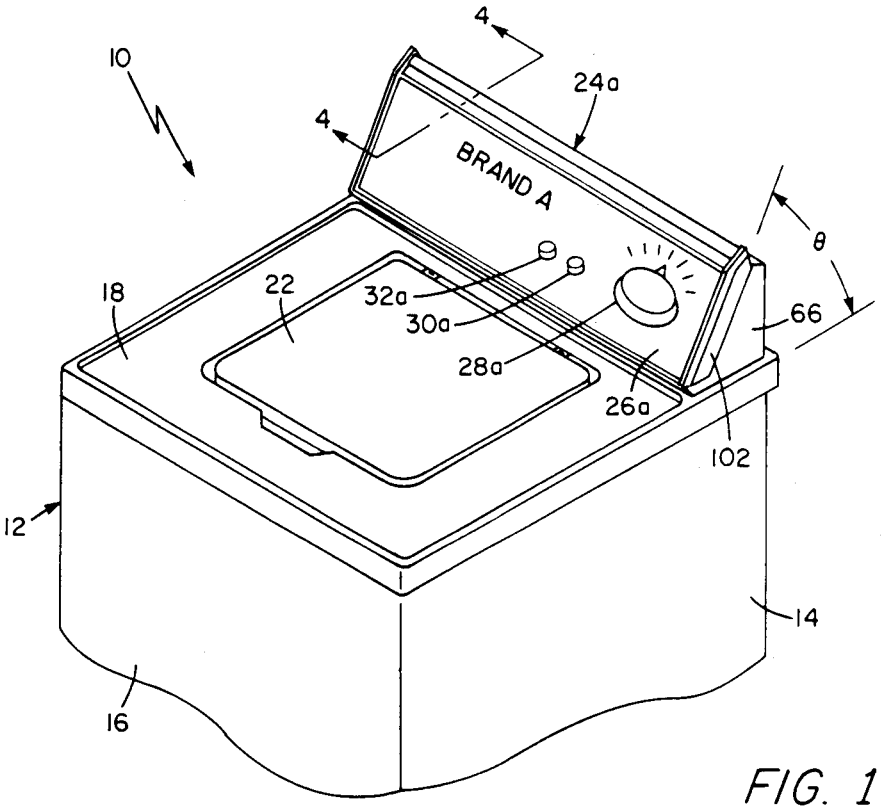
FIG. 1 is a perspective view of a top loading washer with a control console mounted in a first orientation.
Figure 2:
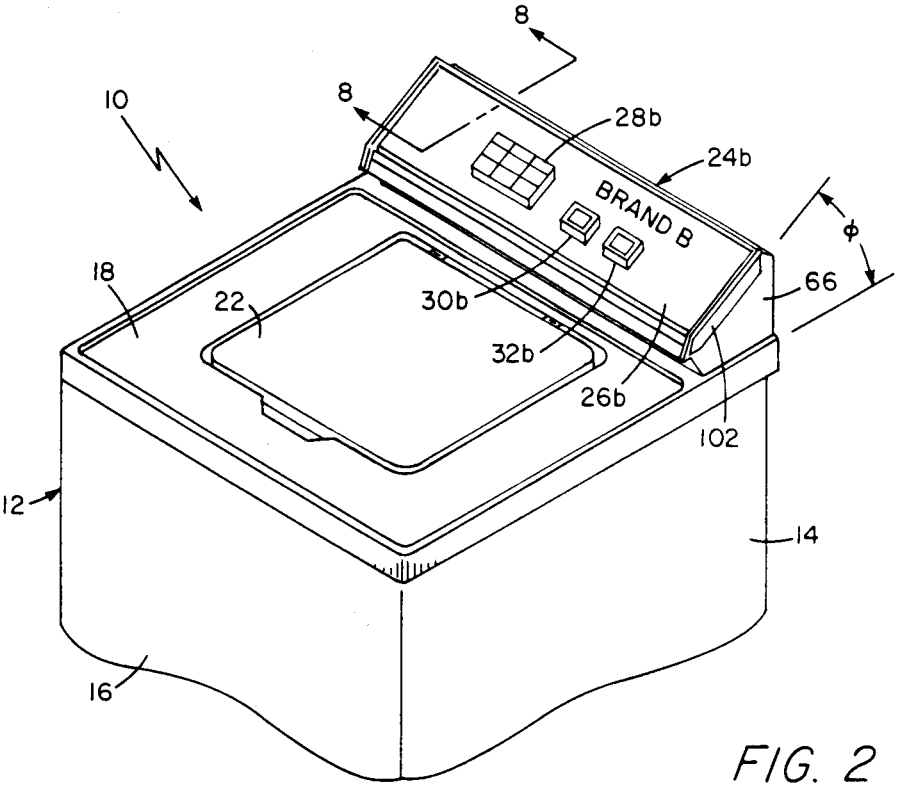
FIG. 2 is the washer of FIG. 1 with the control console mounted in a different orientation.

Referring to FIGS. 1 and 2, there are shown front perspective views of top loading washing machine 10 which generally includes an outer cabinet 12 and an improved control console assembly 24*a* or *b*, respectively, which will be described in detail later herein in accordance with the invention. Outer cabinet 12 encases washing machine components such as, for example, tubs, hoses, valves, a motor, a transmission, etc. which are not shown here because they are conventional and form no part of the invention. Generally, outer cabinet 12 includes side panels 14, a front panel 16, a back panel (not shown), and a cabinet top 18 or top panel. Cabinet top 18 has an access aperture 20 (FIG. 3) for loading and unloading clothes from the top, and a door 22. Although the improved control console assembly 24*a* or *b* is here shown mounted on a top loading washer 10, those skilled in the art will appreciate that the invention can be used to advantage with other types of appliances such as, for example, a front loading clothes washer, a clothes dryer, or a cooking range.

The cabinets 12 of the respective washers 10 in FIGS. 1 and 2 are the same, but the respective washers 10 have a substantially different appearance because the respective control console assemblies 24*a* and 24*b* provide visual differentiation. First, the graphics panel 26*a* on control console assembly 24*a* identifies the washer 10 as BRAND A, and the graphics panel 26*b* on control console assembly 24*b* identifies the washer 10 as BRAND B. Also, the control knobs 28*a*, 30*a* and 32*a* on console assembly 24*a* have a different appearances and mounting locations than control knobs 28*b*, 30*b* and 32*b* on console assembly 24*b*. More importantly, however, console assemblies 24*a* and 24*b* appear to have different shapes because they have different mounting orientations, even though the same hood 34 (FIG. 3) is used in manufacturing both console assemblies 24*a* and 24*b*. More specifically, the graphics panel 26*a* in FIG. 1 has a much steeper slope with respect to cabinet top 18 than the graphics panel 26*b* in FIG. 2. Also, graphics panel 26*b* is elevated or spaced above cabinet top 18 much more than graphics panel 26*a*. In accordance with the invention, the different geometrical appearance of console 24*b* with respect to console 24*a* is provided by using the same hood 34, but inverting its mounting orientation on cabinet top 18. Accordingly, console and appliance differentiation is provided in the marketplace even though the manufacturer needs to fabricate and stock only one part for hood 34.

Figure 3:
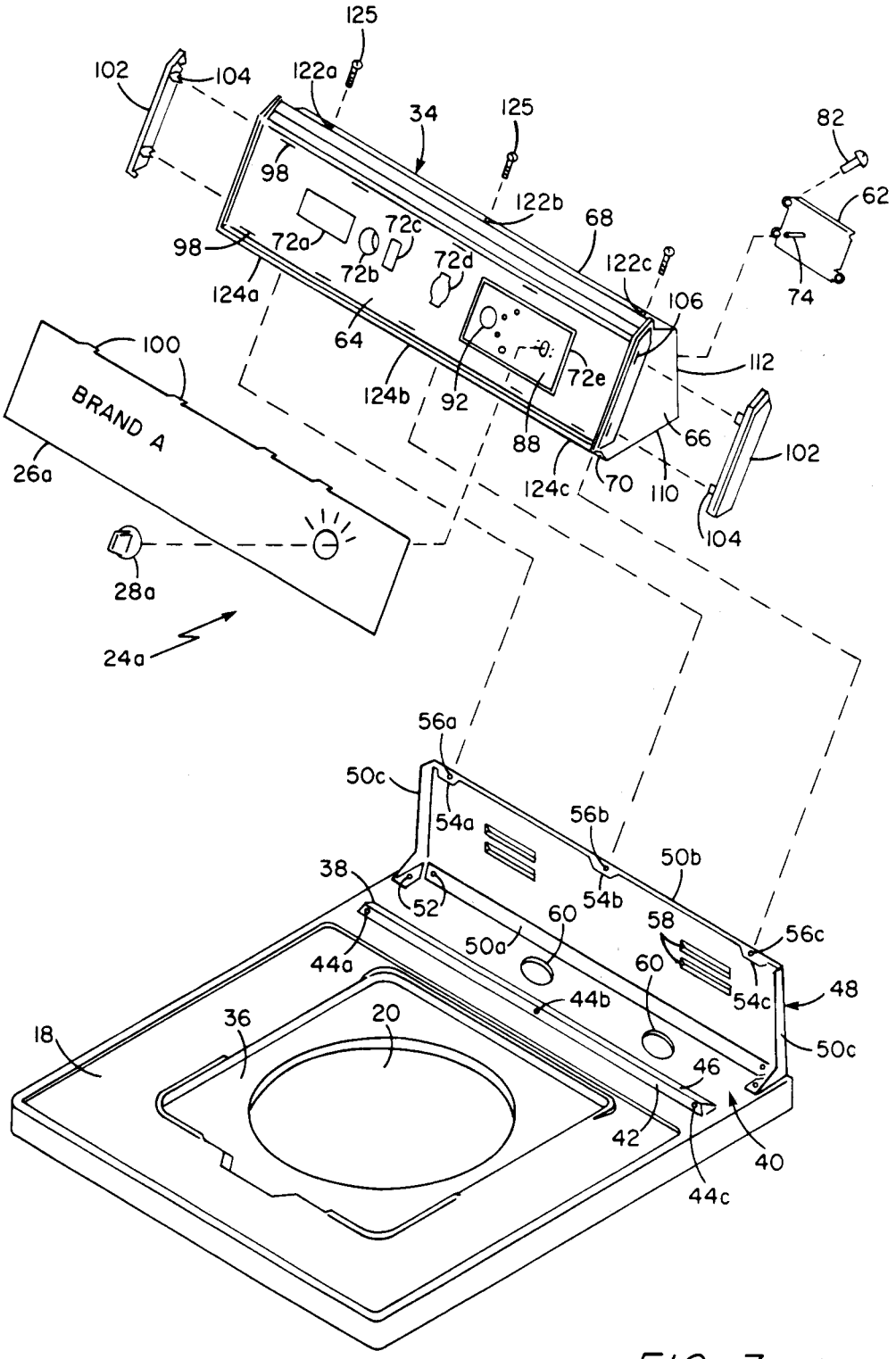
FIG. 3 is an exploded view of the control console assembly and the washer top panel.

Referring to FIG. 3, there is shown an exploded view of control console assembly 24*a* as oriented and mounted in FIG. 1. Door 22 is removed revealing recess 36 in which access opening 20 is formed in cabinet top 18. As shown in more detail in FIG. 4, which is a side sectioned view taken along line 4—4 of FIG. 1, cabinet top 18 has an embossed ridge 38 or mound extending laterally behind recess 36 in the region 40 of cabinet top 18 on which control console assembly 24*a* mounts. Ridge 38 has a steeply inclined front surface 42 with three screw holes 44*a–c*, and a gradually sloped rear surface 46. Rear panel 48 for control hood 34 is mounted vertically at the rear of cabinet top 18. Rear panel 48 has a lip 50*a–d* or flange around its perimeter. Screws 52 are secured through bottom lip 50*a* to securely attach rear panel 48 to cabinet top 18. Top lip 50*b* has three segments 54*a*, *b* and *c* that are bent substantially horizontal, and for reasons to be described hereinafter, the remainder of top lip 50*b* is upwardly inclined. Segments 54*a*, *b* and *c* each have screw holes 56*a*, *b* and *c*. Louvers 58 in rear panel 48 provide ventilation for the interior of control console assembly 24*a*. Holes 60 in cabinet top 18 are provided for routing control cables or tubes (not shown) from control console assembly 24*a* or *b* to the components in outer cabinet 12. Both rear panel 48 and cabinet top 18 are fabricated from sheet metal.

Figure 4:
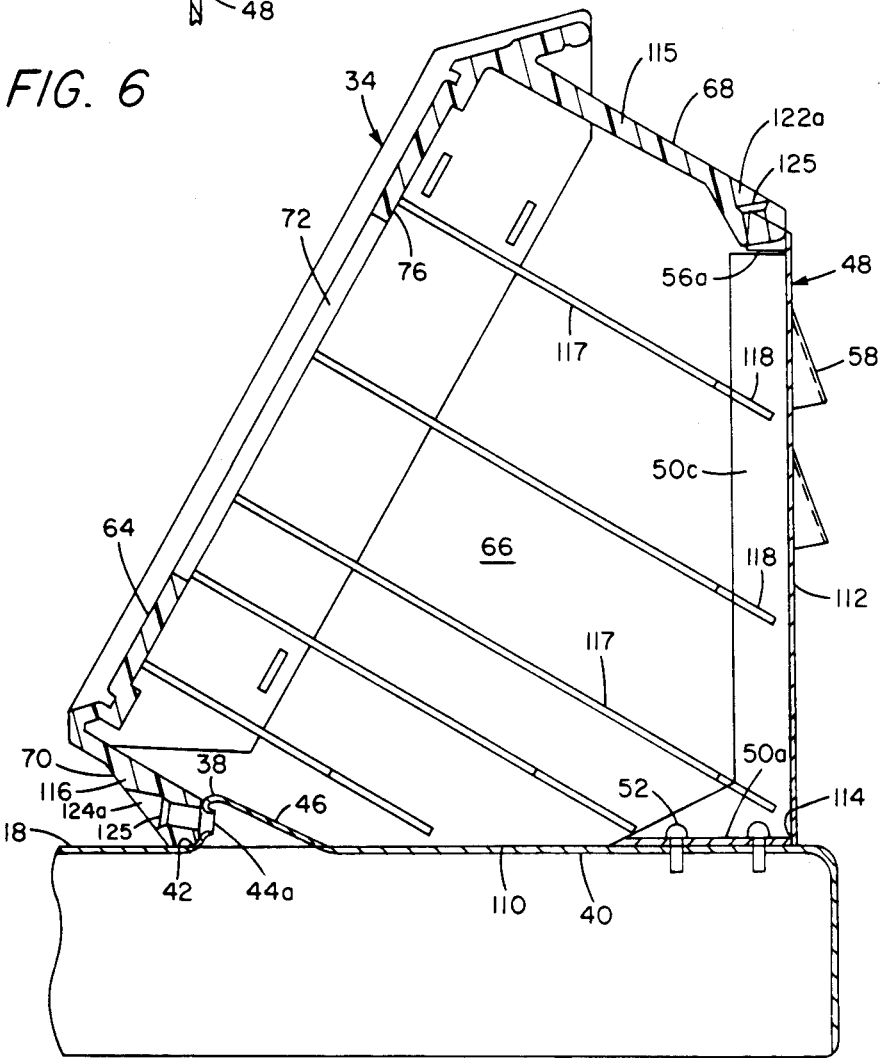
FIG. 4 is a section view taken along line 4—4 of FIG. 1.
Figure 5:
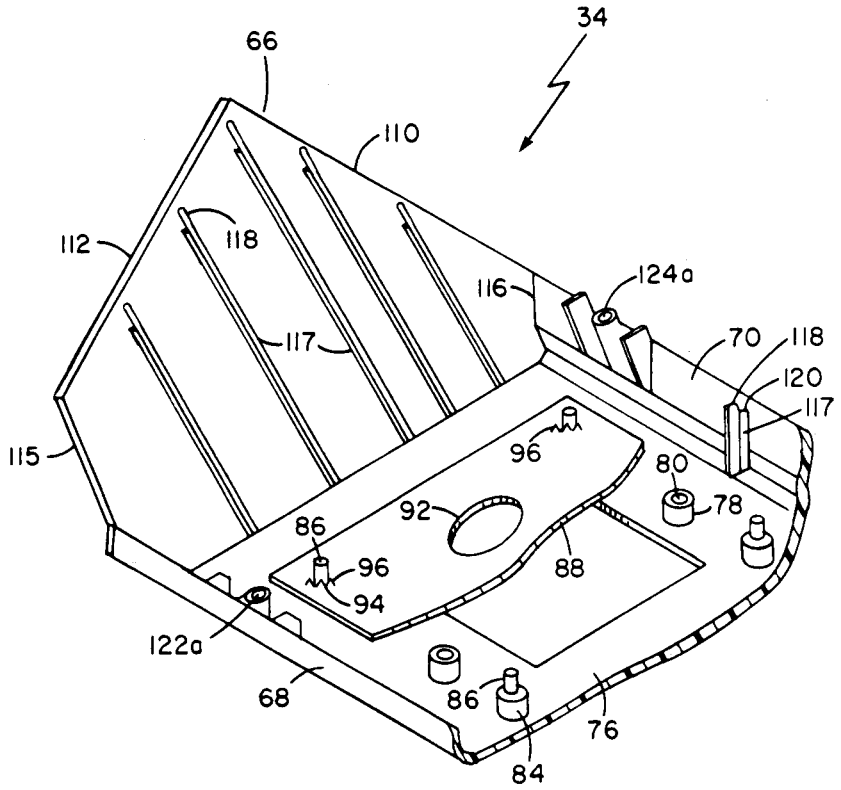
FIG. 5 is a perspective view of a portion of the back of the console hood.

Still referring to FIGS. 3, 4 and also FIG. 5 which shows a rear perspective view of hood 34 or console, hood 34 provides a housing or enclosure for mounting controls 62. Hood 34, which preferably is an integral plastic molded part, includes a control mounting panel 64 or face plate, a pair of ends 66 or end caps, and cross slats 68 and 70. Control mounting panel 64 has a plurality of apertures 72*a–e* through which shafts 74 or other operator actuable portions of controls 62 extend. The back 76 of control mounting panel 64 has a plurality of cylindrical posts 78 with bores 80 for receiving mounting screws 82 for controls 62, and a plurality of columns 84 with projecting studs 86 for mounting control brackets 88. To simplify illustration, only one control 62 is shown in FIG. 3. Accordingly, most of the apertures 72*a–d*, cylindrical posts 78, and studs 86 are not used in the arrangement depicted. The shapes and patterns of apertures 72*a–e*, cylindrical posts 78, and studs 86 are provided so that a wide variety of controls 62 can be mounted on control mounting panel 64 in various configurations with control mounting panel 64 in either a normal or inverted orientation. More specifically, hood 34 is a universal part that can be used for a variety of different models and brands of appliances. For example, in a very basic model using just one or a couple of controls as shown in FIG. 3, control 62 may be a simple timer for a clothes dryer. On other higher line models and on clothes washers, there may be many other controls such as, for example, cycle selectors, timers, temperature selectors, load selectors, etc., and all of these controls could be mounted on the same control mounting panel 64 for the various configurations in either the normal or inverted orientation of mounting panel 64.

Still referring to FIG. 5, metal mounting bracket 88 has a predetermined and universal arrangement of apertures 92 for control shafts 74, and also has holes 94 with angled inwardly projected stops 96 for engaging and locking on studs 86 when bracket 88 is pushed down over studs 86.

In fabrication, one or more metal mounting brackets 88 may be connected onto respective studs 86. Next, controls 62 may be attached with screws 82 or other suitable fasteners to mounting bracket 88 or cylindrical posts 78, as appropriate. Control mounting panel 64 has a plurality of slots 98 for receiving tabs 100 of graphics panel 26*a* or *b*. Control knobs such as 28*a* or *b*, 30*a* or *b*, or 32*a* or *b* are then positioned on corresponding shafts 74 of controls 62. Finally, decorative and visually differentiating molding 102 may be connected to ends 66 by inserting tabs 104 through slots 106 in the ends 66.

Figure 6:
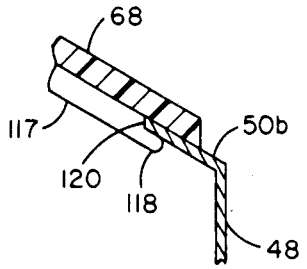
FIG. 6 is a view of the junction between the rear panel and the hood spaced from the view of FIG. 4.

Still referring to FIGS. 3–5, ends 66 each have two alternate support edges 110 and 112 which have substantially the same length and are separated by right angle 114. Ends 66 also include edges 115 and 116 which have different lengths such as, for example, 3 inches and 1½ inches. Edges 115 and 116 respectively border cross slats 68 and 70, and respectively extend between mounting panel 64 and opposing ends of edges 112 and 110. In the mounting orientation of control console assembly 24*a* as shown in FIG. 1 and identified as BRAND A, console assembly 24*a* is supported by edge 110 seating on cabinet top 18 as shown in FIG. 4. Edge 112, being perpendicular to edge 110, extends vertically up along rear panel 48. Ends 66 and cross slats 68 and 70 have ribs 117 which increase the structural rigidity of hood 34. Also, ribs 117 have projections 118 spaced from respective ends 66 and cross slats 68 and 70 which define slots 120 for receiving lips 50*b–d*. More specifically, as shown in FIG. 4, projections 118 on ends 66 extend on the inward sides of lips 50*b* and *d* of rear panel 48 thereby interlocking the ends 66 to rear panel 48. Also, as shown in FIG. 6 which is a view of the engagement of cross slat 68 to lip 50*b* in a lateral region spaced from segments 54*a–c*, the inclined portion lip 50*b* inserts in slot 120 securely engaging cross slat 68 to rear panel 48. More specifically, projections 118 are located on the inward side of lip 50*b* to prevent hood 34 from warping or being bent outwardly.

Cross slats 68 and 70 each have reinforced screw holes 122*a–c* and 124*a–c* which respectively align with screw holes 56*a–c* and 44*a–c*. Screws 125 are used to secure control console assembly 24*a* to cabinet top 118 and rear panel 48.

Figure 7A:
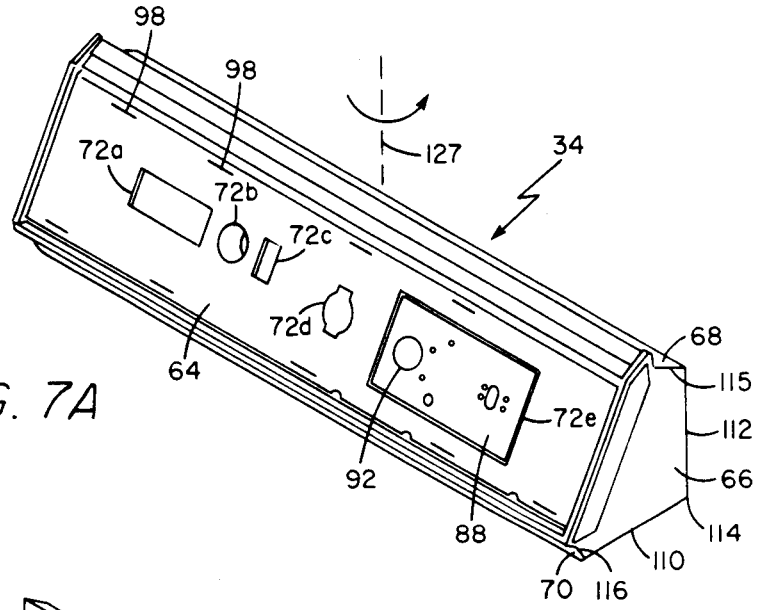
Figure 7B:
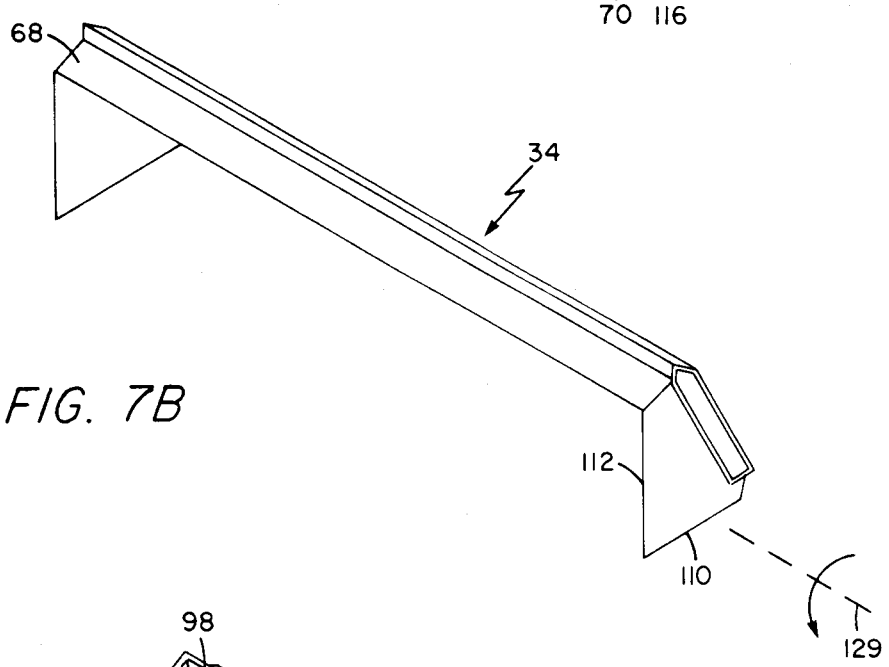
Figure 7C:
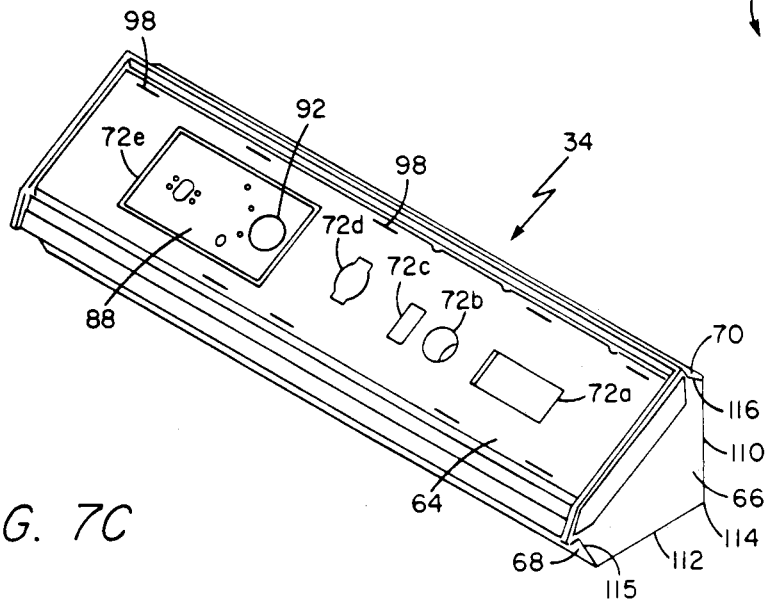

In accordance with the invention, hood 34 can also be mounted in an inverted or substantially inverted position or orientation such that console assembly 24*b* as shown in FIG. 2 has a substantially different visual appearance than console assembly 24*a* as shown in FIG. 1. More specifically, the inverted orientation of hood 34 and console assembly 24*b* is shown in FIG. 2 as identified as BRAND B. Referring to FIGS. 7A–C, there are shown sequential steps in changing the orientation of hood 34 from the orientation of FIG. 1 to the inverted orientation of FIG. 2. More specifically, FIG. 7A shows the orientation of hood 34 for console assembly 24*a* as shown in FIG. 1. In FIG. 7B, hood 34 has been rotated 180° about a vertical axis 127. Next, in FIG. 7C, hood 34 has been rotated 90° about horizontal axis 129 such that edge 112 is now horizontal and becomes the support edge for control console assembly 24*b*, and edge 110 is vertical up along rear panel 48. In the embodiment here shown for hood 34, the angle $\theta$ (FIG. 1) between control mounting panel 64 and support edge 110 is 60°, while the angle $\theta$ (FIG. 2) between control mounting panel 64 and support edge 112 is 30°. Accordingly, by going from the mounting orientation as shown in FIG. 7A and FIG. 1 to the inverted or substantially inverted alternate mounting orientation as shown in FIG. 7C and FIG. 2, the slope of control mounting panel 64 changes from 60° to 30°.

The process of inverting hood 34 also reverses the respective ends 66 in the mounting orientation such that, for example, aperture 72*a*, which is located on the left in FIG. 7A, appears on the right in FIG. 7C. Accordingly, if aperture 72*a* is used to mount the same control 66 in both orientations as shown in FIGS. 7A and 7C, the control 66 will appear on opposite sides of mounting panel 64. As described earlier herein, the shape and pattern of apertures 72*a–e*, cylindrical posts 78, and studs 80 are arranged such that mounting panel 64 can be used to mount a variety of different controls 66 for a variety of different models or brands in both the normal and inverted orientations. Control console assembly 24*b* for the alternate inverted orientation of FIG. 2 is assembled in a similar manner to control console assembly 24*a* as described with reference to FIG. 3. It is apparent that controls 66 will be mounted differently in the inverted orientation, that a different graphics panel 26*b* will be used, and that it will also be desirable to use different decorative molding 102 so as to further provide market differentiation between BRAND A and BRAND B.

Figure 8:
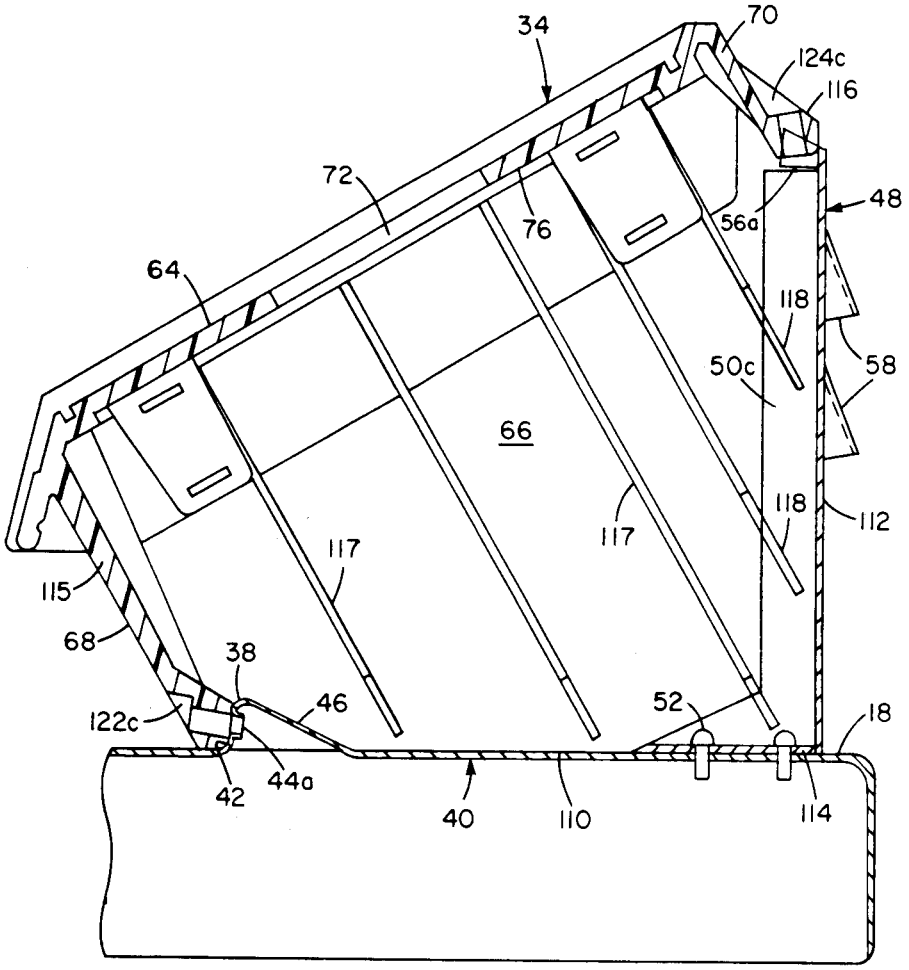
FIG. 8 is a view taken along line 8—8 of FIG. 2.

Referring to FIG. 8, there is shown a sectioned view taken along line 8—8 of FIG. 2, showing control console assembly 24*b* mounted with an inverted orientation from that shown in FIG. 1. Screw holes 122*a–c* which respectively align with screw holes 56*a–c* of rear panel 48 in the orientation of FIG. 1, here align with screw holes 44*c–a* of ridge 28. Similarly, screw holes 124*a–c* which respectively align with screw holes 44*a–c* of ridge 28 in the embodiment of FIG. 1, here align respectively with screw holes 56*c–a* of rear panel 48 in the inverted orientation. In other words, screw holes 122*a–c*, 124*a–c*, and screw holes 44*a–c* and 56*a–c* are located so that they align with respective holes in both the normal and inverted orientations of hood 34. Cross slat 70 like cross slat 68 has ribs 117 which have projections 118 which define slots 120 so that in the alternate inverted orientation of FIGS. 2 and 8, hood 34 is securely engaged to lip 50*b* of rear panel 48.

In the orientation of FIG. 4, cross slat 70 spaces mounting panel 64 from cabinet top 18. However, in the inverted orientation of FIG. 8, cross slat 68 spaces mounting panel 64 from cabinet top 18. Because edge 115 of cross slat 68 is longer than edge 116 of cross slat 70, such as, for example, 3 inches as compared to 1 inch, mounting panel 64 is elevated or spaced from cabinet top 18 a greater distance in the orientation of FIG. 8 than in FIG. 4. Also, in the respective mounting orientations, the angle of cross slat 68 with respect to top 18 is steeper than the angle of cross slat 70 with respect to top 18. The difference in spacing between the control mounting panel 64 and the cabinet top 18 also contributes to the respective orientations of FIG. 1 and FIG. 2 having substantially different appearances.

In accordance with the invention, a versatile hood 34 and console assembly 24*a* or *b* are provided that can be used for manufacturing a variety of different models or brands that have significantly different geometrical appearances using the same universal part. The different appearances are important for providing market differentiation.

This concludes the description of the preferred embodiment. The reading of it by those skilled in the art will bring to mind many modifications and alterations that do not depart from the spirit and scope of the invention. 5 Accordingly, it is intended that the scope of the invention only be limited by the appended claims.

What is claimed is:

1. A control console housing adapted for mounting on an appliance top panel in first and second alternate orientations comprising:

a substantially rectangular control mounting panel having ends;

a pair of end panels connected perpendicular to respective ones of said ends of said control mounting panel, each of said end panels having a first edge for seating on the top said appliance top panel and supporting said control mounting panel in said first mounting orientation, each of said end panels further having a second edge for seating on the top said appliance top panel and supporting said control mounting panel in said second mounting orientation wherein said control mounting panel is inverted from said first mounting orientation, said first and second edges having different angles with respect to said control mounting panel wherein said control mounting panel is supported at different angles with respect to said appliance top panel in said first and second orientations; and means for securing said housing to said appliance top panel in both said first and second mounting orientations.

2. The control console housing recited in claim 1 wherein said housing is an integral plastic molded part.

3. A control console housing adapted for mounting on an appliance top panel in first and second alternate orientations comprising:

a control mounting panel;

a pair of end panels connected to the ends of said control mounting panel, each of said end panels having a first edge for seating on said appliance top panel in said first mounting orientation and a second edge for seating on said appliance top panel in said second mounting orientation;

means for securing said housing to said appliance top panel in both said first and second mounting orientations;

said control mounting panel in said second orientation being substantially inverted from said first orientation;

the angle between said first edge and said control mounting panel being different than the angle between said second edge and said mounting panel whereby said control mounting panel has a different slope with respect to said appliance top panel in said first and second orientations; and said first and second edges being at right angles to each other.

4. The control console housing recited in claim 3 wherein said end panels further comprise a third edge for spacing the bottom of said control mounting panel further from said appliance top panel in said second orientation than in said first orientation.

5. A control console hood for mounting on an appliance top in alternate first and second mounting orientations substantially inverted from each other, comprising:

a laterally elongated face plate having at least one aperture for mounting controls;

end caps mounted to the ends of said face plate, each of said end caps having first, second, and third edges, said first edge supporting said housing in said first mounting orientation, said second edge supporting said housing in said alternate second mounting orientation, said third edge being between said second edge and said face plate for elevating the bottom of said face plate from said appliance in said second orientation, said first and second edges being at right angles to each other and having different angles of intersection with the plane of said face plate; and means for connecting said console hood to said appliance top panel in both said first and second alternate mounting orientations.

6. An appliance, comprising;

an appliance cabinet having a top panel with a laterally running ridge;

a console back panel connected to said top panel at the rear thereof;

a control console hood having a control mounting panel and a pair of end caps each having a first edge for seating on said top panel in a first mounting orientation and a second edge perpendicular to said first edge for seating on said top panel in an alternate second mounting orientation substantially inverted from said first orientation, said control mounting panel having a different slope with respect to said top panel in said first and second orientations; and said hood further comprising means for mounting to said ridge and said console back panel in both said first and second orientations, respectively.

7. The appliance recited in claim 6 wherein said ridge and said back panel each have a plurality of screw holes, and said mounting means of said hood comprises a plurality of screw holes which respectively align with said ridge and back panel screw holes in both said first and second mounting orientations of said hood.

8. The appliance recited in claim 6 wherein said back panel has forward extending lips, said screw holes of said back panel being located in said lip.

9. The appliance recited in claim 8 wherein said hood has ribs engaging said lips of said back panel in said first and second alternate orientations.

10. The appliance recited in claim 6 wherein said control mounting panel has a plurality of bosses extending inwardly and being adapted to align with a mounting bracket in both said first and second alternate mounting orientations.

* * * * *